United States Patent [19]

Ott

[11] Patent Number: 4,794,499

[45] Date of Patent: Dec. 27, 1988

[54] GROUNDING DEVICE FOR LAMP WITH SHIELDED ELECTRODES

[76] Inventor: John N. Ott, 8118 Sanderling Rd., Sarasota, Fla. 33581

[21] Appl. No.: 156,156

[22] Filed: Feb. 16, 1988

[51] Int. Cl.[4] ..... F21S 3/00

[52] U.S. Cl. ..... 362/217; 362/255; 362/260; 313/492; 250/515.1

[58] Field of Search ..... 362/217, 218, 221, 255, 362/260, 263, 264, 265; 313/493, 324, 492, 613, 634; 250/515.1

[56] References Cited

U.S. PATENT DOCUMENTS

| | | | |
|---|---|---|---|
| 3,767,957 | 10/1973 | Ott | 313/492 |
| 3,885,150 | 5/1975 | Ott | 362/290 X |
| 4,684,810 | 8/1987 | Fisher et al. | 313/492 X |

*Primary Examiner*—Stephen F. Husar

*Attorney, Agent, or Firm*—McDermott Will & Emery

[57] ABSTRACT

A grounding device for a fluorescent lamp of the type having a tubular envelope with electrodes at the ends between which an electric discharge occurs. Radiation shields around the electrodes prevent emission of electrode radiation from the lamp and a grounding element connects the shields to the ground.

6 Claims, 1 Drawing Sheet

GROUNDING DEVICE FOR LAMP WITH SHIELDED ELECTRODES

BACKGROUND OF THE INVENTION

This invention relates to fluorescent electric discharge lamps of the type commonly used as a source of artificial illumination.

It is now recognized that natural electromagnetic radiation from the sun and sky is an important environmental element affecting the health, growth and development of plants, animals and human beings. Also, it has been recognized that unnatural man-made radiation sources including, but not limited to artificial light sources, may constitute health and safety hazards if they emit radiation which has substantial energy distortions at various wavelengths as compared with natural radiation under which life on earth has evolved. The term "light pollution" has been used in describing the biological effects of light from artificial light sources whose radiations are characterized by such distortions. Since visible light lies in a relatively narrow wavelength band of 380 to 770 nanometers, a general term would be "radiation pollution" so as to encompass all wavelengths of the electromagnetic spectrum. Public concern with the problem of radiation pollution is evidenced by the enactment of Public Law No. 90-602 known as the "Radiation Control for Health and Safety Act of 1968." This act is designed to study and control "electronic product radiation" and covers "any ionizing or nonionizing electromagnetic or particulate radiation."

In the range of visible light, energy distortion of an artificial light source as compared with a standard such as natural sunlight, can be measured quite accurately by use of a spectrophotometer. With the aid of such measurements, light sources have been designed which emit visible light approximating natural daylight in spectral composition. Recently fluorescent lamps have become commercially available having light-emitting phosphors providing a spectral balance closer to natural light.

With respect to radiation pollution occurring outside the range of visible light, e.g., ultraviolet, infrared, X-rays, cosmic rays, etc., the problem of detecting radiation distortions and their biological effects is much more difficult. One reason for the difficulty is that measurement of such radiations by conventional measuring methods, particularly at low energy levels, is not precise. Another reason is the difficulty in determining the long-term effects of low energy radiation distortion at various wavelengths.

Extensive studies by the inventor of plant growth under artificial light sources using time-lapse photography techniques have revealed that plants are very sensitive indicators of artificial radiation distortion. Lights used for photographic purposes having radiation deficiencies and distortions compared with natural light caused a variety of physiological responses in plants. For example, one type of photographic light resulted in the development of all male buds on a pumpkin vine whereas a different type of light resulted in the development of all female buds. It has been shown that radiation distortion affecting plants may also influence physiological growth responses in animals. Thus, it has been demonstrated that the sex ratio of guppies and mice born of parents kept under different types of artificial light is affected. Still further, it is now known that light entering the eyes of human beings triggers the release of hormones affecting body chemistry and that the effect is dependent on the wavelength of light entering the eye.

One effect that has been noted is that unnatural radiation may affect the seed germination and growth rate of plants. By comparing the germination and growth rate of a group of seeds exposed to radiation being investigated with that of another group of seeds exposed to natural radiation, a reliable and effective way is provided for detection of radiation pollution.

Experiments performed by the inventor using plants grown under fluorescent lamps have revealed the existence of radiation from the electrode area of the lamp which is different from the radiation from the lamp phosphor coating which provides the illumination. Also, the experiments showed that such electrode radiation is a form of radiation pollution in that it produces abnormal growth responses of plants exposed to fluorescent lamps as a source of illumnination. Since fluorescent lamps are often used in greenhouses to expedite plant growth, it is desirable to eliminate such electrode radiation. The effect of electrode radiation from fluorescent lamps on animals and human beings is not known. However, since experiements have shown that unnatural radiation may produce abnormal growth responses in animals and human beings by affecting the endocrine system, it is believed to be desirable for health reasons to eliminate as far as possible all sources of radiation pollution including electrode radiation from fluorescent lamps.

Accordingly, it is an object of the present invention to provide an improved fluorescent lamp constructed to prevent emission of electrode radiation.

Another object of the invention is to provide a fluorescent lamp and housing construction having a grounded shield adjacent the electrodes designed and located so as to prevent emission from the lamp of electrode radiation without substantial interference with the emission of the illuminating light produced by the lamp phosphors.

A further object of the invention is to provide an inexpensive grounded radiation shield and housing construction that can be easily applied to fluorescent lamp fixtures to reduce or eliminate emission from the lamps of electrode radiation.

Further objects and advantages of the invention will become apparent as the following description proceeds.

SUMMARY

It has been discovered that fluorescent lamps emit from the area of the electrodes at each end of the enclosing glass envelope radiation which penetrates the envelope and produces abnormal growth responses in plants exposed to illumination from the lamp. While the wavelength of this radiation is not known, experiments have shown that it can be shielded by use of materials, such as lead, similar to those used to shield X-rays. It has further been shown that grounding of these shields through the lamp housing will increase the shield's effectiveness. According to the invention, grounded absorption shields are mounted on the fluorescent lamp so as to enclose and shield the electrode area of the lamp without masking to any great extent the light-emitting area of the tube. The shields are grounded through the lamp housing.

For a better understanding of the invention, reference should be made to the following detailed description taken in connection with the accompanying drawings.

DESCRIPTION OF THE ILLUSTRATED EMBODIMENTS

Figure 1:
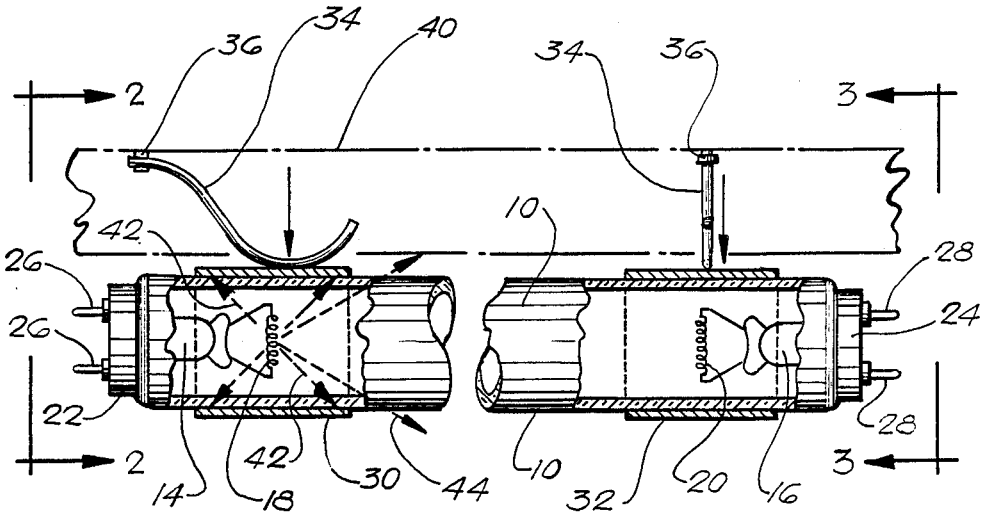
FIG. 1 is a side view, partly in section, of a fluorescent lamp and housing embodying grounded electrode radiation shields constructed in accordance with the invention.

FIG. 1 of the drawing shows a fluorescent lamp and fixture provided with grounded electrode radiation shields in accordance with the invention. The fluorescent lamp itself may be as shown, a conventional type commonly used for artificial illumination. The lamp comprises a sealed, elongated tubular envelope 10 made of glass having a coating 12 of phosphor on its inside surface and hermetically sealed at its ends to stems 14 and 16. Supported on lead-in wires extending inwardly from stems 14 and 16 are electrodes 18 and 20 which may be in the form of coiled filaments formed of tungsten wire and coated with a suitable electron-emitting material such as the usual alkaline earth oxides. Base members 22 and 24 cemented to the ends of the envelope carry contact pins 26 and 28 which are electrically connected to electrodes 18 and 20 through the lead-in wires. The contact pins 26 and 28 are adapted to be received in sockets (not shown) through which connections are made to a suitable source of power in circuit with the usual starter and ballast in a well-known manner. The envelope is filled with low-pressure mercury vapor and a rare gas such as argon. When starting voltage is applied across the electrodes, an arc discharge takes place through the filling gas emitting ultraviolet radiation which excites the phosphor coating 12 to produce visible light passing outwardly through the glass envelope as is well understood by those skilled in the art.

Experiments have been conducted by the inventor growing plants such as beans from seed using 80 watt fluorescent lamps similar to that described above as a source of artificial illumination. Seeds were planted at various distances ranging from 1 foot to 10 feet from the electrodes 18 and 20 and periodic observations made on their germination and growth rate. It was found that seeds close to the electrodes showed abnormal growth responses while those located 10 feet from the electrodes germinated and grew in a normal manner. Seeds planted at intermediate distances showed diminished abnormal growth responses the extent of which appeared to be a function of the distance from the electrodes. From these experiments, I concluded that radiation from the electrode area, as distinguished from radiation from the lamp phosphor coating, was affecting the germination and growth of the plant seeds. To verify this, the experiments were repeated with all conditions the same except that a grounded shielding material was placed between the electrode areas of the lamp and the plant seeds. The shielding material used was lead similar to that used to shield X-rays. When grounded shielding was used, all plant seeds germinated and grew in a normal manner and at about the same rate. In order to make a practical use of this discovery, shields are applied to fluorescent lamps and connected to ground through a housing in a manner to be described so as to shield the general area illuminated by the lamp from radiation generated in the electrode areas of the lamp.

In the embodiment illustrated in FIG. 1, cylindrical radiation shields 30 and 32 are placed around envelope 10 adjacent the ends thereof so as to encompass the electrodes 18 and 20 as shown. The shields are formed of material having sufficient density and thickness to absorb the electrode radiation from the lamp. Shields as small as 2 mils thick formed of a material having a high atomic number such as lead have been found satisfactory for use on an 80 watt fluorescent lamp. The required radiation absorption capacity of the shields will vary with the output, operating voltage and starting characteristics of the lamp. In general, it is believed to be desirable to reduce by shielding the electrode radiation emitted by the lamp to a value not substantially exceeding natural radiation from the sun and sky so as to avoid radiation pollution in the area illuminated by the lamp.

This invention improves prior shielding devices by including a grounding device 34 in contact with the shields 30 and 32. The grounding device 34 is preferably in the shape of a flexible wire or whisker as shown in FIG. 1. The wire 34 is connected by suitable connecting means 36 to the housing 40 for the lamp. The lamp housing is shown in phantom lines and is typically of metal and coated to reflect most of the emitted light in a particular direction. The attachment means 36 electrically connects the wire 34 to the housing and the housing 40 is grounded so that there is continuity to ground through the grounding device to the shield 30 or 32. It has been found that grounding the shield in this manner further reduces the electrode radiation emitted by the lamp electrodes 18 and 20.

Figure 2:
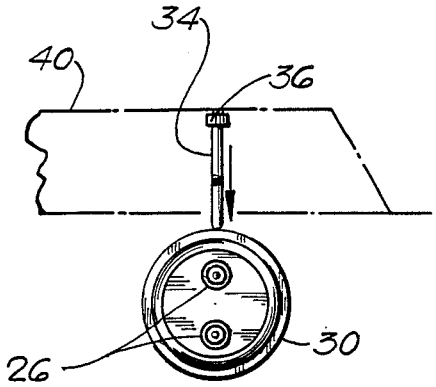
FIG. 2 is an end view of the grounded shield taken along line 2—2 of FIG. 1.
Figure 3:
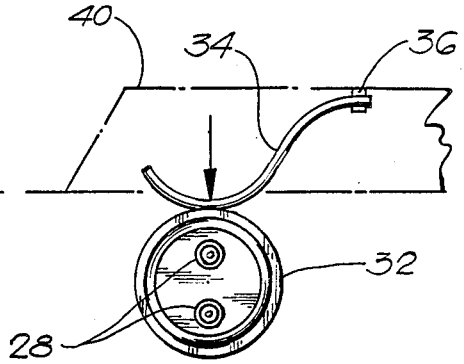
FIG. 3 illustrates the preferred shield grounding construction taken generally along lines 3—3 of FIG. 1 wherein the grounding device is transverse to the tube.

The grounding devices 34 are a part of the housing and contact the shields 30 and 32 when a fluorescent tube 10 is mounted in the fixture. The grounding device 34 may be parallel to the axis of the tube as shown in FIG. 2 or transverse to the axis of the tube as shown in FIG. 3. It has been found that the design of FIG. 3 is preferable since most fluorescent lighting fixtures include end mounting members for the tubes which require the tubes to be turned approximately 90° after insertion to make the appropriate electrical connection to the pins 26 and 28 and to support the bulb within the fixture. However, any manner of grounding the electrodes is satisfactory and the present invention is not limited to the particular shape, design or of making contact between the grounding device 34 and the shields 30 and 32. The flexible wire or whisker of the grounding device 34 has been found to be a suitable and relatively inexpensive method of effecting the shield ground.

The shields 30 and 32 may be formed and applied to the lamp by wrapping a foil strip around the lamp having the desired thickness. Alternatively, the shields may be preformed in tubular shape and dimensioned to be slid over the ends of the tube and secured in place by any suitable method such as cementing. Another installation method is to form the shield as two half cylinders which can be installed around the electrode areas of the lamp and secured by screw or clamping fasteners. For application to large size lamps, it may be desirable to blacken the shields, for example with a carbon coating, to radiate heat effectively and avoid overheating of the lamp. Heat-radiating fins projecting from the shields may also be used for this purpose.

With shields having a cylindrical configuration such as shown in FIG. 1, most of the outward electrode radiation in the direction of arrows 42 will be intercepted and absorbed by the shield. Radiation emitted at an angle closer to an axial direction of the tube as illustrated by arrows 44 may bypass the shield and be radiated from the lamp. However, for many lamp installations where the lamps are suspended in a horizontal position near the ceiling, such escaping radiation will be directed away from the light utilization area which is usually near the floor. In order not to detract unduly from the lighting efficiency of the lamp by masking part of the lamp producing light by emission from the phosphor coating, the axial length of the shield should not be made longer than necessary to obtain the desired electrode radiation shielding.

If desired, the grounding device 34 may be formed integrally with the fluorescent lamp housing during its manufacture. For example, a flexible tab may be formed in the housing and positioned to contact the shields 30 and 32.

The manner in which the electrode radiation is generated in a fluorescent lamp is not known. However, it may be generated by bombardment of the electrodes by electrons and ions during the half cycle of the A.C. voltage when the electrode acts as an anode. For that reason the shields, which might otherwise act as radiation generators, are preferably mounted so as not to be in the stream of electrons and charged particles flowing between the lamp electrodes. This can be conveniently accomplished by mounting the shields on the outside of the lamp envelope as shown in the illustrated embodiments of the invention.

While there have been shown what are presently considered to be preferred embodiments of the invention, it will be apparent to those skilled in the art that various changes and modifications may be made without departing from the spirit and scope of the invention.

What is claimed as new and desired to be secured by Letters Patent of the United States is:

1. In a fluorescent lamp fixture including a housing and fluorescent lamp of the type comprising a sealed, elongated tubular light-conducting envelope containing an arc-conducting gas, a light emitting phosphor coating on the inside of the envelope and electron-emitting electrodes at each end of the envelope electrically connected to conductors extending through the ends of the envelope, grounded shielding means for preventing emission outside the walls of the envelope of radiation generated in the electrode area of the lamp, said grounded shielding means comprising:

a shielding member mounted on said lamp envelope outside the path of the arc discharge between the lamp electrodes and arranged to extend around the electrode area of the lamp envelope, said shielding member having sufficient thickness and axial length to absorb substantially all of the radiation emanating from the electrode area of the lamp around which it extends, and;

a grounding member mounted on the housing of the lamp fixture at a position in contact with the shielding member.

2. The fluorescent lamp fixture as set forth in claim 1 wherein the shielding member is constructed of material having a high atomic number and density which will absorb radiation.

3. The fluorescent lamp fixture of claim 1 wherein the shielding means comprises two spaced grounded shielding members mounted on the lamp to extend around the electrodes on both ends of the lamp.

4. The fluorescent lamp fixture of claim 1 wherein the grounding member is connected to ground through the fluorescent lamp fixture housing.

5. The fluorescent lamp fixture of claim 4 wherein the grounding member is yieldable to permit insertion of the lamp into the lamp fixture to electrically connect the lamp to a source of power.

6. The fluorescent lamp fixture of claim 5 wherein the grounding member is in the form and shape of a flexible wire connected to the housing in a position so as to generally extend transversely to the axis of the fluorescent tube mounted in the housing.

* * * * *